US005609190A

United States Patent [19]

Anderson et al.

[11] Patent Number: 5,609,190

[45] Date of Patent: Mar. 11, 1997

[54] AUTOMATED REFUELING SYSTEM

[75] Inventors: Scott R. Anderson, North Vancouver; Chin T. Tham, Burnaby; Joseph A. Padula, Vancouver; Owen R. Williams; Jesse S. Houle, both of New Westminster; David A. Besler, Burnaby, all of Canada; William D. Ramsey, Jr., Kingwood, Tex.

[73] Assignee: Shell Oil Company, Houston, Tex.

[21] Appl. No.: 461,281

[22] Filed: Jun. 5, 1995

[51] Int. Cl.[6] ..... B65B 1/04; B65B 3/04

[52] U.S. Cl. ..... 141/59; 141/94; 141/98; 141/114; 141/392; 138/112; 138/114

[58] Field of Search ..... 141/59, 98, 94, 141/114, 231, 312, 368, 382, 388, 392, 206; 222/527; 138/114, 112, 108; 239/428.5

[56] References Cited

U.S. PATENT DOCUMENTS

| | | | |
|---|---|---|---|
| 3,527,268 | 9/1970 | Ginsburgh | 141/98 |
| 3,580,414 | 5/1971 | Ginsburgh et al. | 220/86 |
| 3,590,890 | 7/1971 | Young | 141/382 |
| 3,642,036 | 2/1972 | Ginsburgh et al. | 141/94 |
| 4,749,010 | 6/1988 | Petell | 141/59 |
| 4,881,581 | 11/1989 | Hollerback | 141/113 |
| 5,238,034 | 8/1993 | Corfitsen | 141/94 |
| 5,404,923 | 4/1995 | Yamamoto et al. | 141/279 |

FOREIGN PATENT DOCUMENTS

| | | |
|---|---|---|
| 418744A2 | 6/1994 | European Pat. Off. . |
| 4242243A1 | 3/1991 | Germany . |
| WO94/03391 | 2/1994 | WIPO . |
| WO95/32919 | 12/1995 | WIPO . |

OTHER PUBLICATIONS

"Lawrence Livermore Laboratory: Hoping to Make Highways Safer," *Technology Transfer Business,* Fall 1994, 1 page.

Dawn Stover, "Radar on a Chip, 101 Uses in Your Life" *Popular Science,* Mar. 1995, 6 pages.

Cheryl Ajluni, "Low–Cost Wideband Spread–Spectrum Device Promises to Revolutionize Radar Proximity Sensors," *Electronic Design,* Jul. 25, 1994, 2 pages.

*Technology,* "Pumping Gas in the Year 2000," by Klaus–Ulrich Blumenstock and Konstantin Tschovikov, 3 pp. (no available date).

*Primary Examiner*—Henry J. Recla
*Assistant Examiner*—Steven O. Douglas
*Attorney, Agent, or Firm*—Del S. Christensen

[57] ABSTRACT

A refuelling system is provided, the system comprising: a seal cylinder defining the outside surface of an axial vapor recovery volume within the seal cylinder having a first end and a second end; a first flexible conduit to supply fuel to within the seal cylinder through the first end; a movable seal piston within the seal cylinder connected to the first flexible conduit, the seal piston effective to isolate a vapor recovery volume within the seal cylinder from the atmosphere surrounding the flexible fuel conduit; a fuel insert tube connected to the seal piston and extending through at least a portion of the vapor recovery volume; a boot seal attached to the seal cylinder at the second end of the axial vapor recovery volume, the boot seal effective to seal with a fuel tank inlet nozzle; and a device to move the seal piston laterally through the seal cylinder and thereby extending the second flexible conduit through the second end of the axial vapor recovery volume and into a fuel tank inlet nozzle when the boot seal is mated to the fuel tank inlet nozzle.

14 Claims, 9 Drawing Sheets

FIG.5B
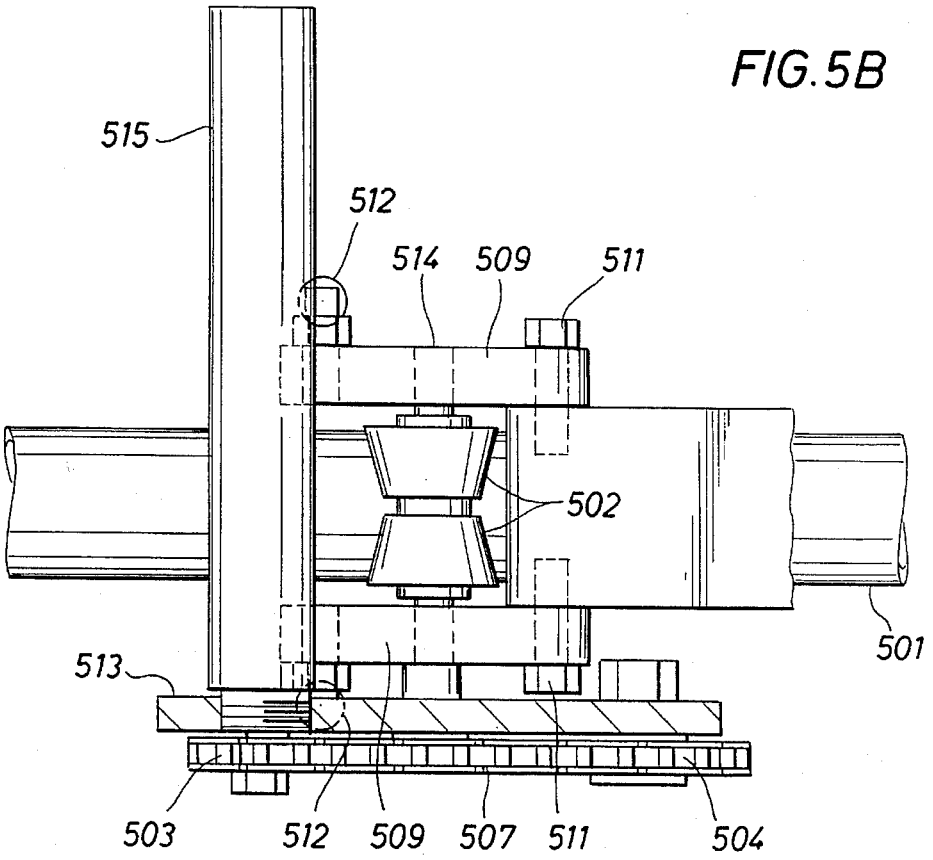
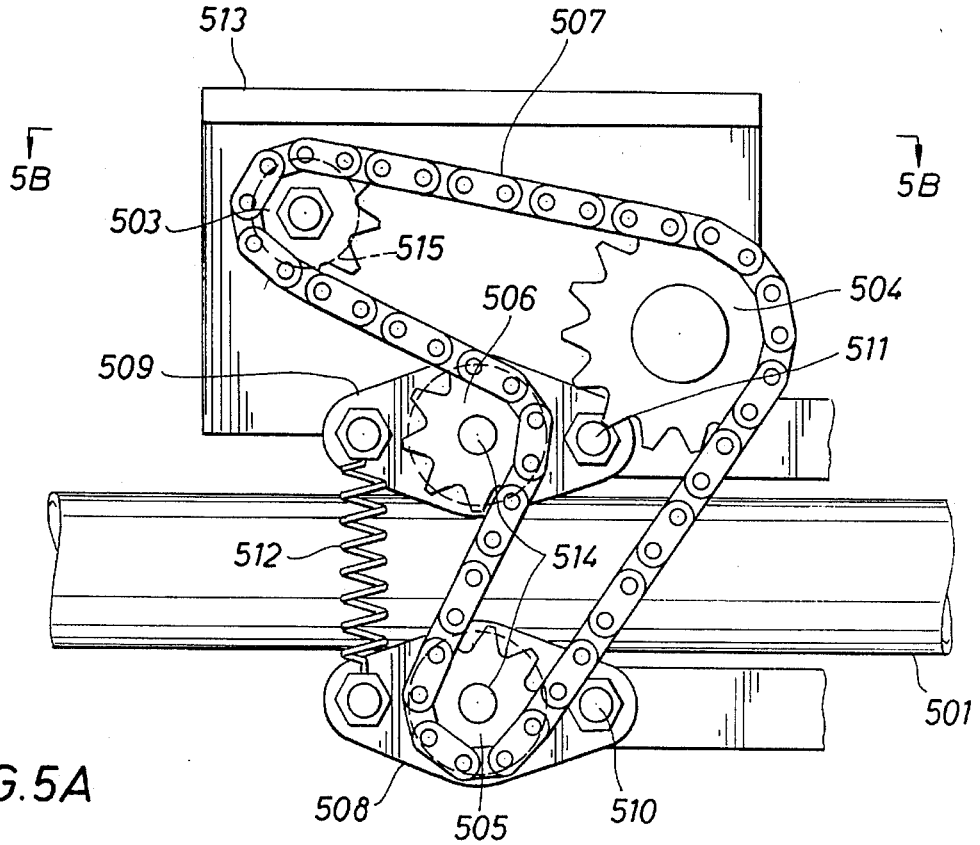
FIG.5A 501
603
602
601
604
605
606
613
610
612
614
622
603
611
613
615
616
620
621
619
624
618
617
607
610

FIG. 7A
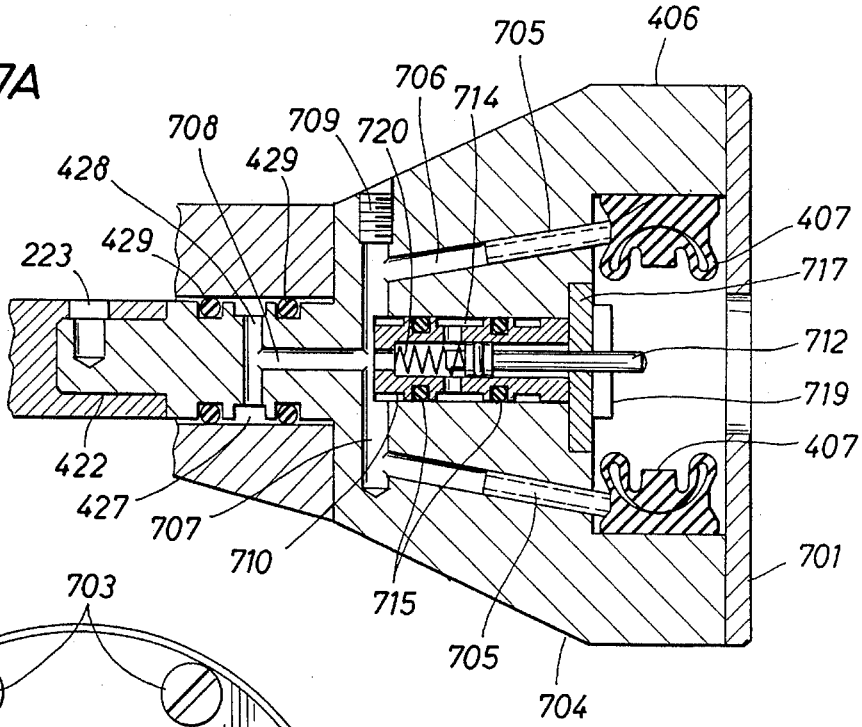
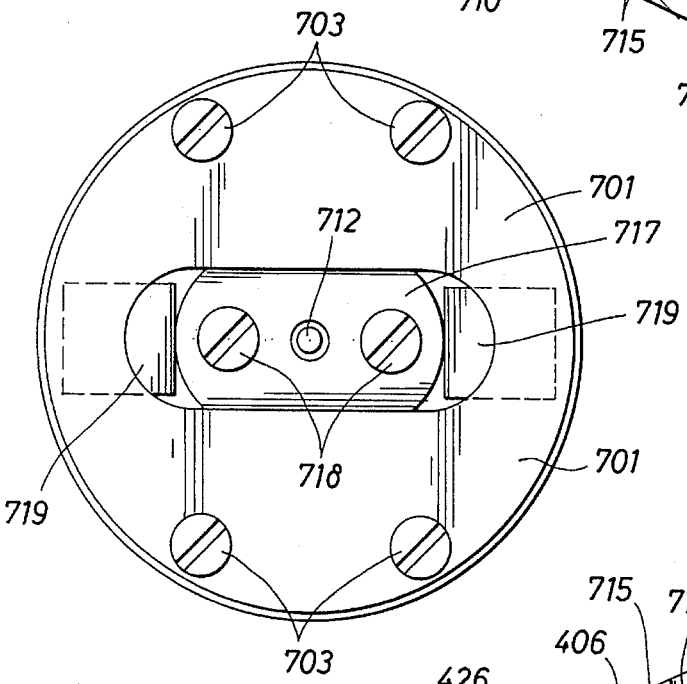
FIG. 7C
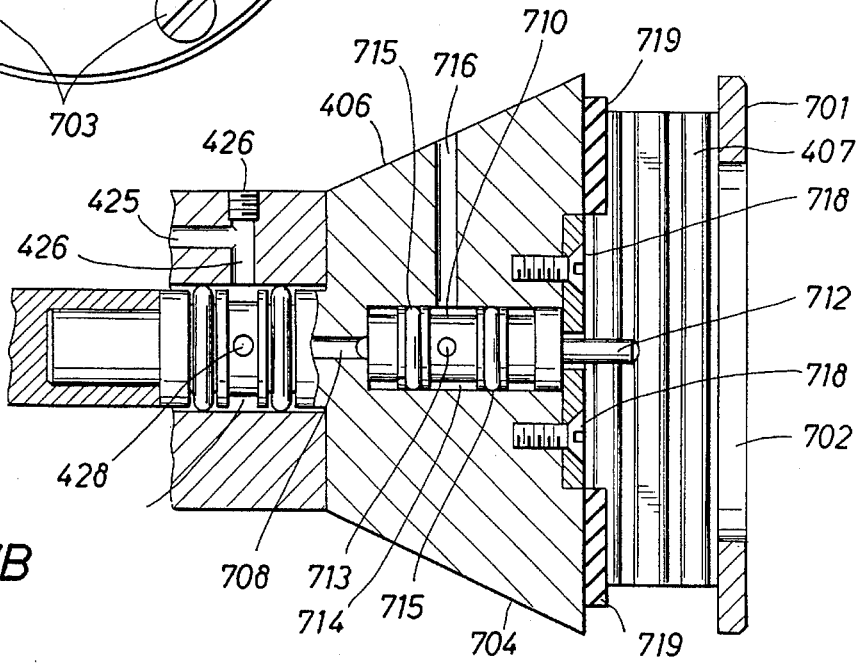
FIG. 7B

AUTOMATED REFUELING SYSTEM

FIELD OF INVENTION

This invention relates to an apparatus for automated refuelling of vehicles.

BACKGROUND TO THE INVENTION

Numerous apparatuses have been proposed for automatic refuelling of vehicles, but none have been commercially applied to retail gasoline outlets because of the expense and complexity of the systems. To be economically competitive with customers ability to refuel automobiles manually, or an attendant, such an automated refuelling system must be relatively simple, and must be assembled from relatively inexpensive components. Additionally, it is necessary that modifications to the vehicle to be refuelled be minimal.

U.S. Pat. No. 3,527,268 suggests an automated refuelling system that includes a movable head having three functional arms, an arm to open a gas cap cover lid, an arm to remove a gas cap, and a fuel fill nozzle that is inserted into the fuel inlet. There are therefore five physical steps used: fuel cap lid opening; cap removal; fuel fill step; cap replacement; and cap lid closure. The apparatus of '268 must be repositioned after each of these five operations. This repositioning adds to the complexity of any control scheme, adds to the time required to complete the operation, and results in an operation that would be perceived by the customer as unduly complex. Additionally, '268 initiates fuel flow upon the fuel tube being extended until a limit switch indicates it is fully extended. The initial positioning of the end effector must therefore be extremely accurate with relationship to the fuel inlet nozzle to provide any sort of seal on the fuel inlet. This precise of positioning with relationship to the fuel inlet nozzle is not possible because of variations in dimensions of fuel tank inlet tubes, variations in the installation of fuel tanks in vehicles, and variations in installation of fenders on the vehicles. Even if the position of the fuel inlet is determined by the position of the gas cap, the angle of the fuel inlet orifice to vertical may vary sufficiently to prevent a seal being achieved at a predetermined fuel fill tube extension.

The apparatus of patent '268 reposition the end-effector for the different operations by rotation of the head of the end-effector. The connections and control conduits must therefore all be rotatable, and many require rotatable seals. This adds considerable cost and complexity to the apparatus of '268.

EPO Patent Publication No. 0 418 744 A2 suggests a robot that is mounted on a track adjacent to a stall in which a vehicle to be refuelled is to be parked. In the apparatus of Publication '744, the robot picks up a selected refuelling nozzle and inserts the nozzle into a specially provided insert in the vehicle's fuel inlet. Besides for the specially provided insert for the fuel inlet, the vehicle needed to be modified to provide the driver the capability of opening and closing the fuel inlet cover lid from the inside of the vehicle.

Patent PCT/IT/00017 suggests an automated refuelling apparatus much like that of patent '268, but with a line of center of rotation turned 90° from the line of center of rotation of the fuel dispensing head. PCT/IT/00017 also suggests positions of the filling cover door and the fuel plug indicated by cameras searching for reflectors and fluorescent paint. Fuel flow is initiated when a sensor touches the fuel inlet, indicating that the fuel nozzle is inserted into the inlet.

This mechanism would not necessarily indicate that a sealing contact is made.

It is therefore an object of the present invention to provide an apparatus for automated refuelling of vehicles that is relatively simple and inexpensive, and wherein emissions of hydrocarbon vapors to the atmosphere are reduced by refuelling with a sealing contact between the fuel supply nozzle and the vehicle fuel inlet. It is a further object to provide such an apparatus wherein a refuelling nozzle does not require significant repositioning to perform different operations such as cap removal, fuel cap cover lid opening, refuelling, and replacement of the cap.

SUMMARY OF THE INVENTION

The objectives of the present invention are accomplished by providing a refuelling system comprising: a seal cylinder defining the outside surface of an axial vapor recovery volume within the seal cylinder having a first end and a second end; a first flexible conduit to supply fuel to within the seal cylinder through the first end; a movable seal piston within the seal cylinder connected to the first flexible conduit, the seal piston effective to isolate a vapor recovery volume within the seal cylinder from the atmosphere surrounding the flexible fuel conduit; a fuel insert tube connected to the seal piston and extending through at least a portion of the vapor recovery volume; a boot seal attached to the seal cylinder at the second end of the axial vapor recovery volume, the boot seal effective to seal with a fuel tank inlet nozzle; and a means to move the seal piston laterally through the seal cylinder and thereby extending the second flexible conduit through the second end of the axial vapor recovery volume and into a fuel tank inlet nozzle when the boot seal is mated to the fuel tank inlet nozzle.

This refuelling system is preferably an automated refuelling system that includes a means to confirm that a sealing relationship is achieved between the seal boot and a vehicle's fuel inlet nozzle and a means to enable refuelling operation only when such confirmation exists. The refuelling system also preferably includes an arm for removal of a standard automotive fuel tank cap and an arm for opening of a hinged lid covering the fuel tank cap. In another preferred embodiment, the arm provided for opening of a hinged lid covering the fuel tank cap can open and hold the hinged lid in an open position while a vehicle is being refuelled.

The compact design of the refuelling tube and vapor recovery apparatus of the present invention enable placement of an arm for opening of the hinged lid and an arm for removal of the fuel cap adjacent to the refueling tube and thus eliminating any need to move the apparatus significantly to proceed from step to step of the refuelling operation. Refuelling can be accomplished quickly because significant repositioning of the fuel inlet between operations is not required. Not repositioning the fuel inlet nozzle also simplifies the system required to control movement of the fuel inlet nozzle.

BRIEF DESCRIPTION OF THE FIGURES

FIGS. 5A and 5B show views of a means to move a flexible conduit laterally according to the present invention.

FIGS. 7A, 7B, and 7C are, respectively, sectional profile, sectional profile at 90° from first sectional profile, and end view of a fuel cap grabbing head according to the present invention.

DETAILED DESCRIPTION OF THE INVENTION

Figure 1:
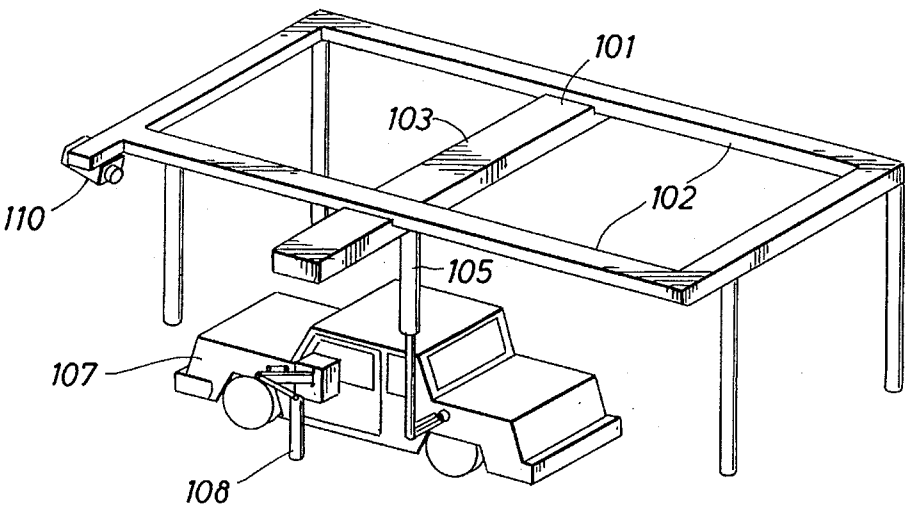
FIG. 1 shows a perspective view of the general arrangement of a preferred refuelling system of the present invention.

Referring now to FIG. 1, the general arrangement of components of a vehicle refuelling system according to a preferred embodiment of the present invention is shown. An overhead gantry 101 with a set of longitudinal supports 102 and a cross member 103 is shown. This gantry can move a nozzle manipulator 105 to position the refuelling nozzle on either side, or the rear of a vehicle, according to the location of the fuel inlet.

The location of the fuel inlet can be determined from data obtained from a transponder card (not shown) preferably place on a windshield of a vehicle to be refueled 107. The transponder card can be one of many commercially available, preferably passive, transponder systems. For example, Amtech, located in Dallas, Tex., offers a transponder card system called "INTELLA TAG" which cards sell for about twenty five U.S. dollars. This transponder card system has a data capacity of 1408 bits, and operate on a radio frequency of 924 Mhz. Motorola Indala, of San Jose, Calif., produces another passive RF transponder system. Motorola's system has a 64 bit capacity that is readable from about two feet. Cards cost about three U.S. dollars, and acceptable readers can be purchased for about 630 U.S. dollars. TIRIS, of Austin, Tex., also offers acceptable systems. Active transponders are also available that operate on watch-type batteries and have significantly greater range. Although active transponders are more expensive, they could be acceptable in the practice of the present invention.

Other means of determining the vehicle type and/or identification could be utilized other than a transponder. For example, an optical bar code could be provided on a sticker on a window, bumper or fender. Magnetic strips could also be provided to transmit this information.

The transponder system of the present invention provides vehicle information to the automated refuelling system thereby allowing the system to know the location of the fuel inlet on the vehicle. Credit card information could also be transmitted automatically, but alternatively, a customer interface 108 including a credit card reader (not shown) may be included. The use of the customer interface and credit card reader ensures that the refuelling operation is intentionally initiated by the customer and provides a confirmation that the authorized customer is receiving the refuelling service.

Positioning of the fuel supply nozzle adjacent to the fuel inlet is preferably accomplished by a position sensor located on the fuel supply nozzle. The position sensor determines the position of the fuel supply nozzle in relationship to the fuel supply inlet. This position sensor may be, for example, a magnetic flux determination, with a magnet located on either the fuel inlet, fuel cap or on the hinged lid over the fuel inlet, or a vision system with a visual pick-up located on the fuel supply nozzle with information from the visual pick-up processed by software capable of recognizing the outline of the fuel hinged cover or fuel cap, and most preferably, also the position of the hinged cover about its hinged axis.

If a vision system is utilized to identify the position of the fuel inlet, the vision system may also be used to identify the location of the fuel cap after the hinged cover is opened, and possibly to identify the license plate number of the vehicle, for example, as a security check.

The customer interface is preferably automatically movable in the vertical direction and laterally toward the vehicle so that the interface is easily accessible from the driver's side window without the driver having to open the vehicle door. Movement of the customer interface could be initiated by the automated refuelling system upon a vehicle coming to a stop in a position to be refuelled, and preferably, after a confirmation that the engine of the vehicle has been shutdown. Information obtained from the transponder system could dictate the best vertical height for the customer interface for the particular vehicle. The automated refuelling system also is preferably provided with a means to determine the location of the vehicle relative to the system, and this information can be used to determine the extent of movement toward the vehicle for best placement of the customer interface. The customer interface, in a preferred embodiment, does not move laterally along the axis of the vehicle because the driver is encouraged to pull up to the interface with the interface juxtapose to the driver's side window. This provides that the vehicle will be within reach of the automated refuelling system.

A preferred method and apparatus to determine if the vehicle's engine is operating is disclosed in U.S. Pat. No. 08/461,279, filed Jun. 5, 1995, incorporated herein by reference.

A preferred customer interface is disclosed in U.S. Pat. No. 08/461,275, filed Jun. 5, 1995, incorporated herein by reference.

A simple ultrasonic range determination can alternatively be provided to determine the location of the vehicle relative to the customer interface. A preferred ultrasonic range finding system is available from Polaroid and cost only about fourteen U.S. dollars each. Preferably, an acoustic system is provided to confirm that movement of the customer interface will not cause a collision with the vehicle.

Range finding sensors of the present invention could be, rather than ultrasonic, for example, radar or laser. Ultrasonic systems are presently preferred because they have acceptable sensitivity and are less expensive than currently available alternatives. An acceptable radar based range finding sensor has been recently developed by Lawrence Livermore Laboratories, and has been referred to as a micropower impulse radar, or MIR. This technology has been incorporated in commercial products and is both inexpensive and accurate.

The means to determine the position of the vehicle relative to the automated refuelling system may be, for example, a probe extended to an expected location of a tire, a series of pressure sensors under or in the surface on which the vehicle is located, a series of ultrasonic, radar, laser ranger finders or a vision system. The vision system is shown with a camera 110 positioned above the expected location of the vehicle looking down at the vehicle. The camera produces an image that is captured and reduced to a digital format by a frame grabbing image processing card, and communicated to a central processing unit (not shown). The central processing unit may be located in a convenient location, for example either in a building at the location of the automated refuelling system, or remotely. The vision system can determine from the data provided by the camera the location of the vehicle within the view of the camera. A vision system could also verify that the shape and, if a color camera is utilized, if the color of the vehicle matches the vehicle for which the transponder card is issued.

Automated refuelling will require that measures be taken to prevent overfilling of fuel tanks by the automated refuelling systems. A preferred method to prevent overfilling of fuel tanks includes use of the fuel shut-off mechanism disclosed in U.S. Pat. No. 08/461,487, filed Jun. 5, 1995, incorporated herein by reference.

Figure 2B:
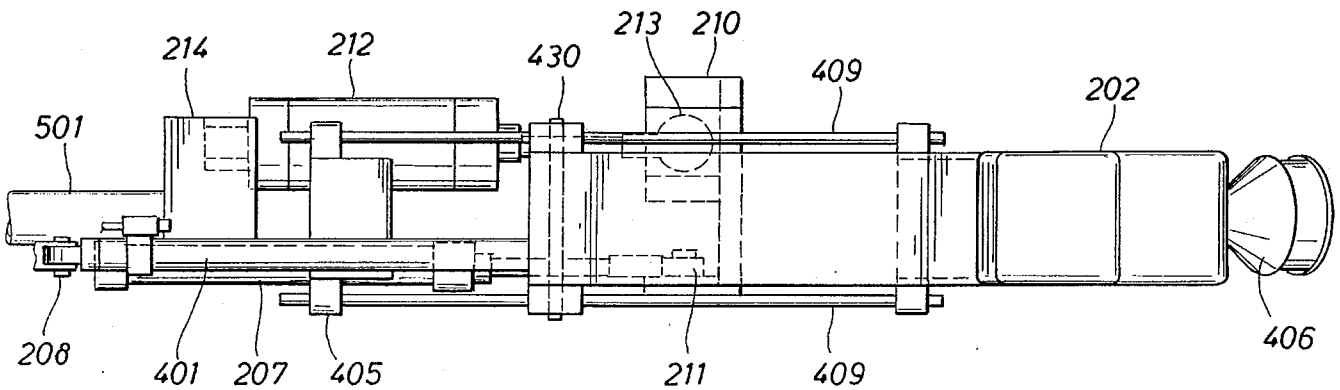
FIG. 2A and FIG. 2B show partial cross sections of a profile and bottom views, respectively, of a preferred embodiment of an end-effector useful in the present invention.
Figure 2A:
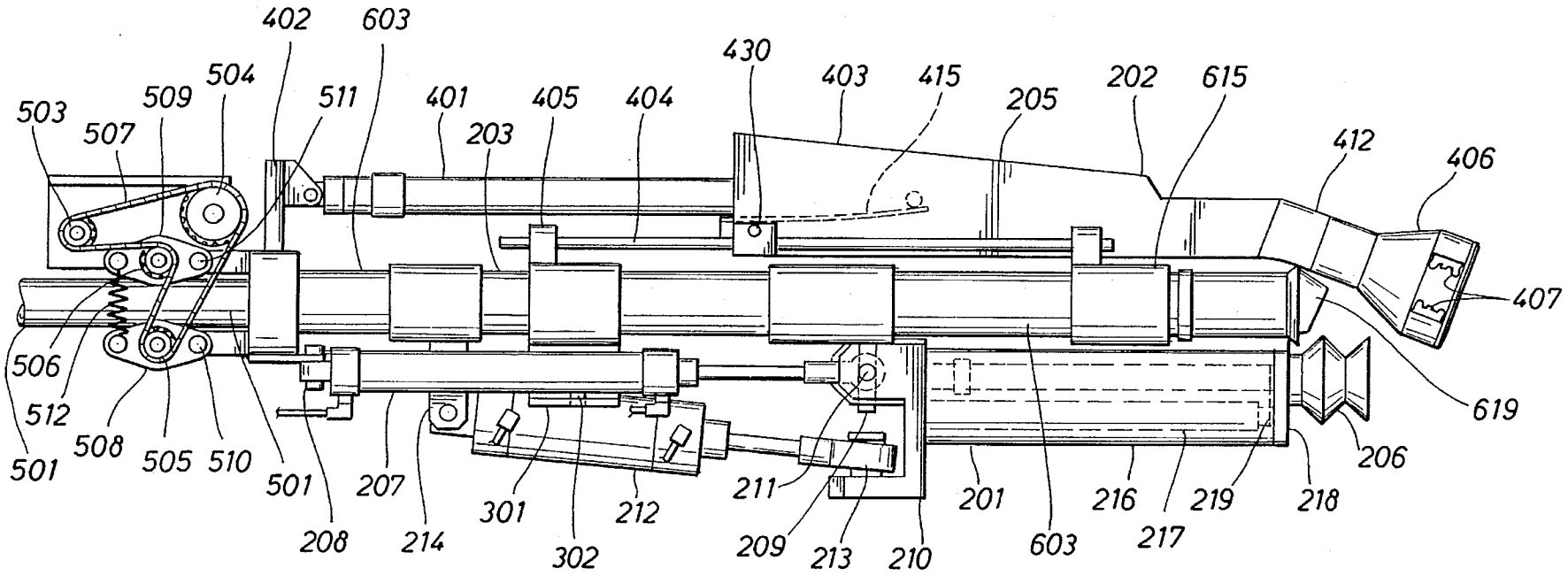

Referring now to FIG. 2A and FIG. 2B, a profile view and a top view, respectively, of an end-effector according to the present invention is shown. The end-effector shown includes an arm for opening a hinged cover lid 201; an arm for removing a gas cap 202; and an arm for extension of a refuelling tube 203 into a vehicles fuel inlet. Each of these arms can function from essentially a single fixed position of the support bracket for the end-effector (not shown). An advantage of this is that a hinged lid can be held in an open position while the cap removal and refuelling operations are completed. A vertically hinged lid, such as a gas inlet behind a license plate, can also be opened by this end-effector. Software for positioning the end-effector is also simplified by not requiring significant movement of the end-effector for different end-effector operations. The operations can also be performed more quickly with less movement of the end-effector.

The hinged lid opening arm 201 supports a flexible suction cup 206 to which either a vacuum or a positive pressure can be applied. A vacuum is utilized for securing a hinged lid. A positive pressure is applied to purge debris from the vacuum system between uses and to operate a suction cup cleaner (not shown) between uses. A yaw movement pneumatic cylinder for the lid opener 207 is anchored at a fixed end 208 and moves the lid opening arm radially around a vertical pivot anchor 209. The vertical pivot anchor is hingably connected to a pitch pivot bracket 210 by a connecting pin 211. The lid opening arm is rotated about the connecting pin 211 by an pitch movement pneumatic cylinder 212 acting between a back end bracket 214 maintained at a fixed position, and rotates the pitch pivot bracket by acting on a universal connection 213.

Figure 3B:
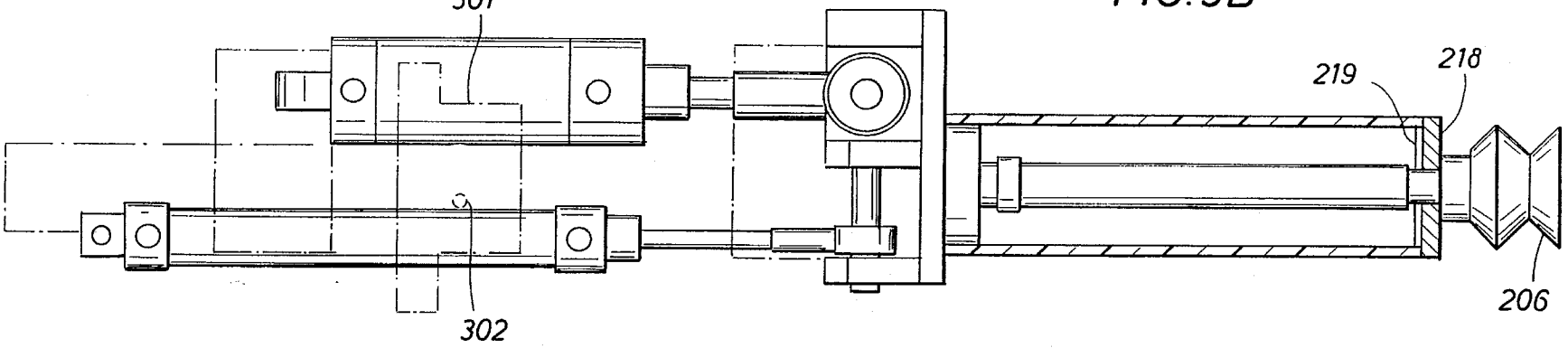
FIGS. 3A and 3B show, respectively, profile and top views of an assembly for opening a hinged lid over a fuel inlet.
Figure 3A:
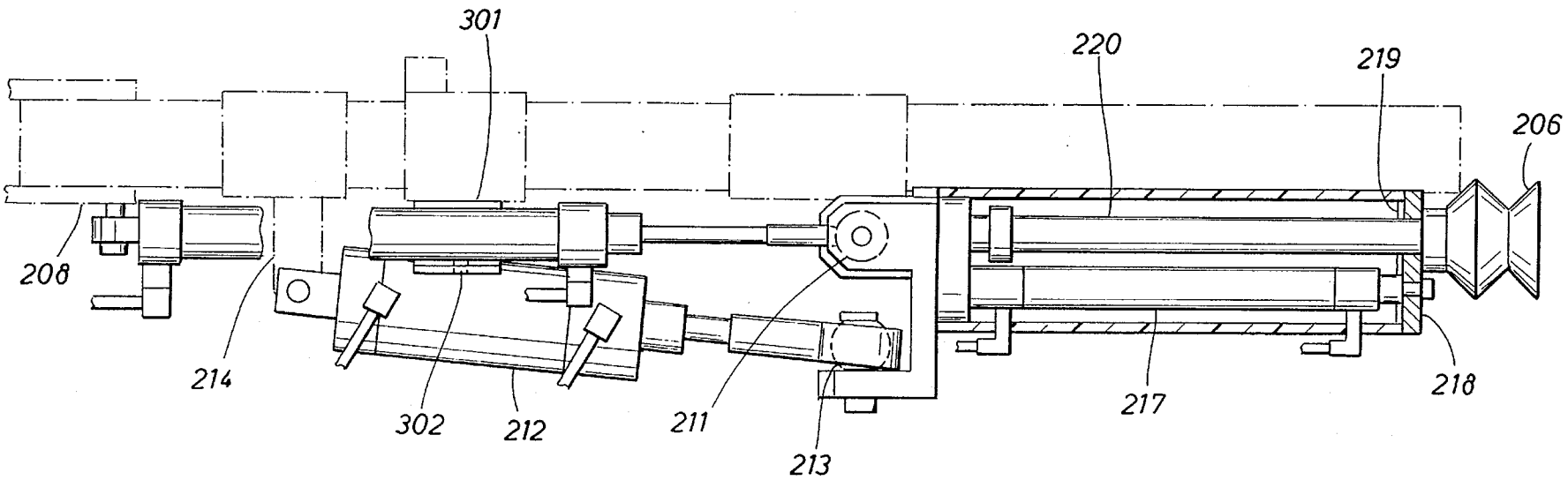
Figure 4B:
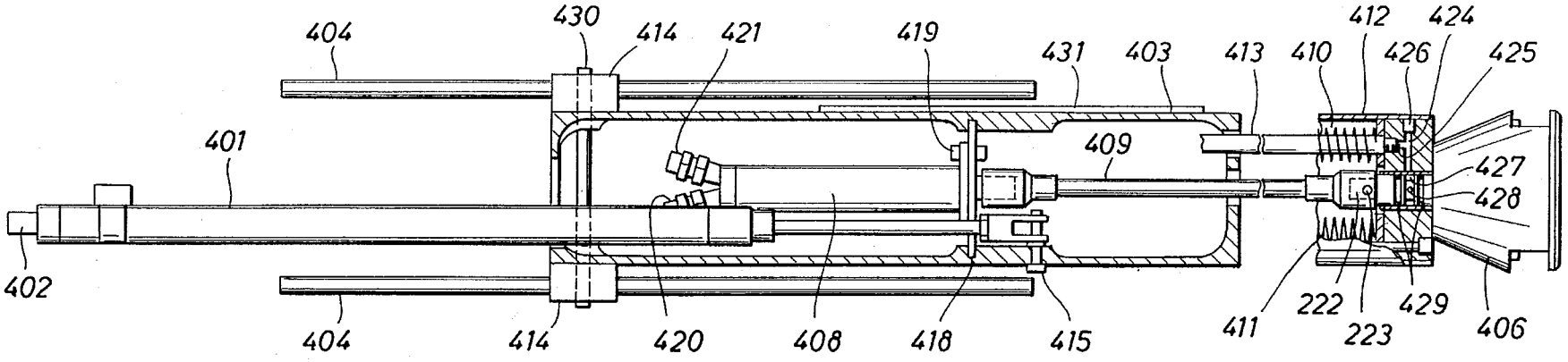
FIGS. 4A and 4B show, respectively, profile and top partial sectional views of a cap-grasping and removal mechanism according to a preferred embodiment of the present invention.
Figure 4A:
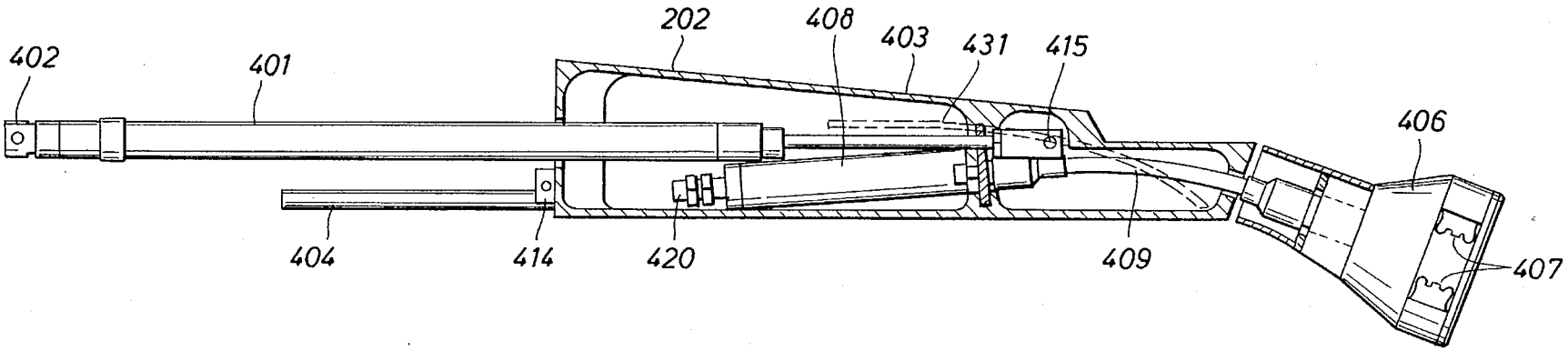
Figures 6A, 6B:
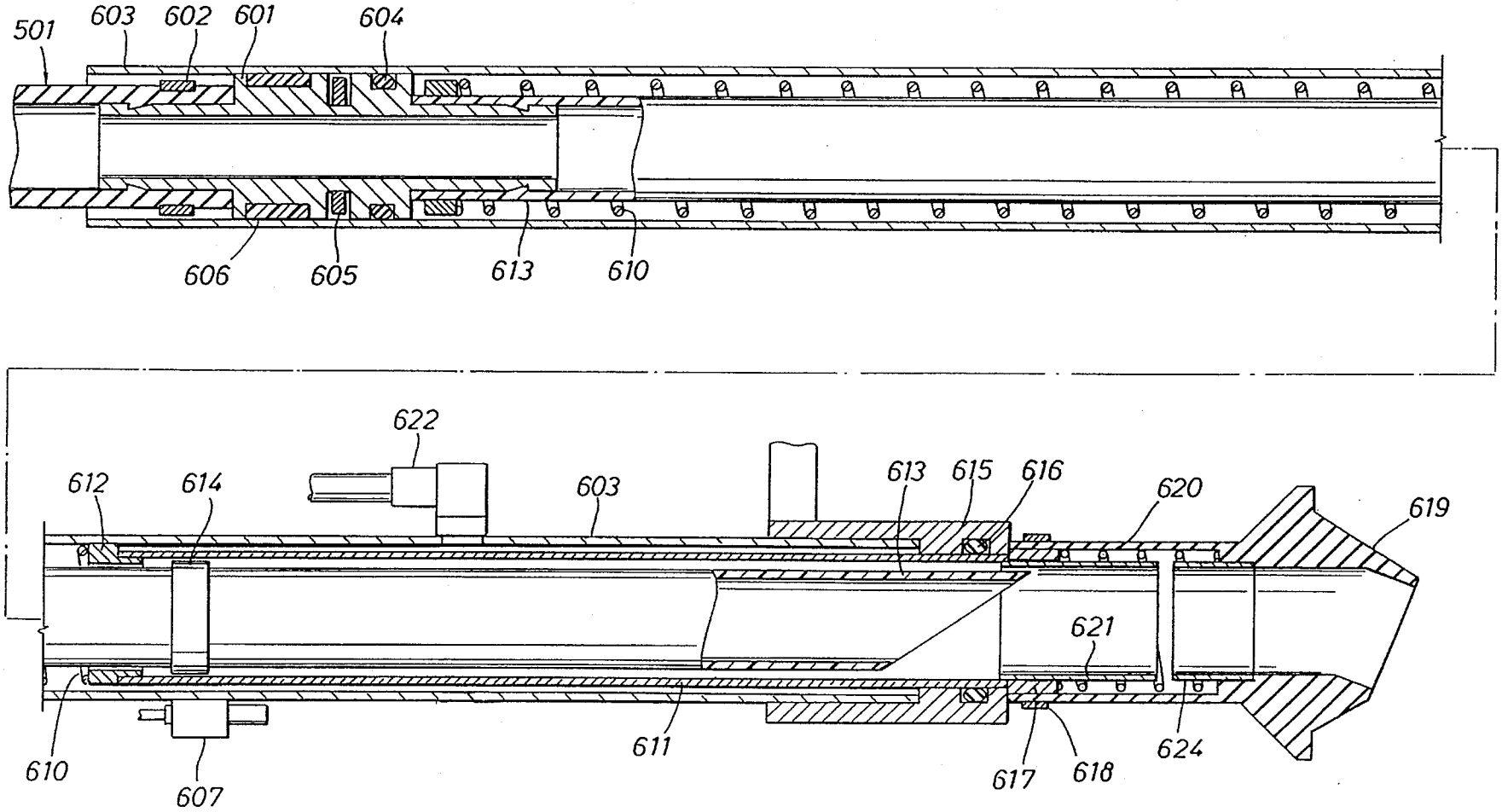
FIGS. 6A and 6B show sectional views of a fuel conduit and a mechanism to insert the fuel conduit into a fuel inlet according to the present invention.

Referring now to FIGS. 3A and 3B, along with FIGS. 2A and 2B, additional details are shown for a mechanism to open a hinged lid over a vehicle's fuel inlet. A lateral movement pneumatic cylinder 217 provides for lateral movement of the flexible suction cup 206. The lateral movement cylinder is anchored at a fixed end to a frame 216 that is attached to the pivot bracket 210 at a fixed end and to a suction cup support plate 218. The suction cup 206 is supported on the end of a push tube 220 that is extendable by providing an inner tube that extends out of or retracts into an inner tube while maintaining a sealing relationship between the outer surface of the inner tube and the inner surface of the outer tube. A vacuum or positive pressure can be provided to the suction cup through the center of the push tube 220. The frame 216 provides for alignment of movement of the push tube by a bracket 219.

A yaw positioning bracket 301 provides a spring pin 302, that urges the yaw movement piston to a straight position. When the yaw pneumatic cylinder is either extended, turning the suction cup to the right, or retracted, pulling the suction cup to the left, the cylinder will be to the left of the straight-ahead lateral position of the yaw cylinder. By providing positioning bracket 301 and spring pin 302, a simple pneumatic cylinder with two positions (extended and retracted) can be provided, with the spring pin maintaining the yaw pneumatic cylinder in a straight-ahead position when the cylinder is placed into that position. Persons of ordinary skill in the art can determine alternatives to the spring pin 302 to bias the yaw cylinder to a middle position.

When the end effector is placed adjacent to a vehicle's fuel inlet, and pointed to a hinged lid of the fuel inlet, the pitch is adjusted to center the fuel conduit on the expected position of the fuel inlet behind the hinged door, and the suction cup is then laterally extended to meet the hinged lid. Prior to the hinged lid contacting the hinged door, a vacuum is applied to the center of the suction cup. When a suction is detected as a sufficiently negative gauge pressure in the suction line going to the suction cup, extension of the suction cup is reversed, and movement of the suction cup to swing the hinged door open is initiated. The shape of the suction cup can provide for sufficient flexibility that the arm can be moved in yaw in a direction to open the hinged lid, and the suction cup will remain in sealing contact with the hinged lid. The hinged lid opening arm therefore does not require a swinging motion around the hinged axis, but only a yaw motion to pull the hinged lid open (along with extension and retraction of the suction cup as described above).

Referring now to FIGS. 2A and 2B and FIGS. 4A and 4B a fuel inlet cap removal arm is shown. A cap removal lateral movement pneumatic cylinder 401 is connected at a fixed end to a cap removal lateral movement fixed bracket 402, and to a sliding housing 403 by a pin 415. The sliding housing is guided by guide rods 404, the guide rods fixed to the end effector by brackets 405. The sliding housing supports a cap grabbing head 406 that fits onto a standard automotive manufacture equipment cap, and latches onto the cap by providing air pressure to flexible grabbing boots, 407. The cap grabbing head can be rotated by rotating motor 408 by flexible shaft 409. The flexible shaft is connected to the grabbing head by a female connection over a shaft 222 protruding from the grabbing head and kept in place with a set screw 223. The rotating motor is anchored to the sliding housing 403 by a rotating anchor mounting plate 418 and rotating anchor mounting screw 419. The cap grabbing head 406 is set in a motor sprocket 412 that does not rotate, but provided a seat for the rotating element. The rotating motion may be in either direction, providing for removal and replacement of the cap. Two pneumatic inlets for the motor are therefore provided, 420 and 421, for rotation in clockwise and counter clockwise directions respectively.

Flexibility is provided to the fit to the cap by mounting the motor sprocket 412 by two springs 410 and 411 to the sliding housing 403. Air pressure is provided to the grabbing boots by air supply 413 and channels 424 and 425 drilled in the motor sprocket, with screw 426 to seal the channel. The channels pass the air pressure to a volume 427 surrounding a shaft of the cap grabbing head which is sealed with two O-rings 429. A channel is provided to the center of the shaft between the two O-rings, meeting a shaft channel 428 drilled through the center of the shaft which then meets channels (not shown) drilled to meet the air inlet of the flexible grabbing boots 407. Additional flexibility of the cap grabbing head fit to the fuel cap is provided by brackets 414 being hingably connected to the sliding housing 205 by axial 430. Because of this hingable connection, a leaf spring 415 is provided to urge the sliding housing toward the alignment rods to that it does not rise upward too easily. The grabbing head therefore is able to move downward as the sliding housing is moved forward, and moves upward as it slides back, therefore helping move the cap and grabbing head 406 move out of the way of the refuelling tube when the grabbing head is retracted. A track 431 is provided to control vertical movement of the grabbing head as a function of lateral position such that extension of the cap grabbing head also lowers the cap grabbing head toward the center of the fuel inlet. The track 431 rides on a pin (not shown) provided on bracket 615.

Referring now to FIGS. 7A, 7B, and 7C, details of the cap grabbing head 406 are shown. An end plate 701 provides a flat surface for the grabbing head to rotate around on a fuel cap until the raised ridge of the fuel cap aligns with an opening 702 in the end plate. The end plate is connected to a body 704 of the grabbing head by flat head screws 703. Inflatable boots 407 have inlet tubes 705 extending into machined channels for air supply 706. The channels for air supply are connected by a drilled perpendicular channel 707 that connects to a centerline channel 708. The perpendicular channel is plugged where it is drilled through the surface of the head by plug 709.

When pressure is applied to the inflatable boots 407 it is difficult to slip the grabbing head over a fuel cap, so a pin spool 710 is provided to vent air pressure from the air supply to the inflatable boots when a cap in not being grabbed by the cap grabbing head. When a cap raised ridge is not within the cap grabbing head, spring pin 712 is urged outward by a spring within the pin spool 720. With the pin urged outward, air pressure is relieved by a path through the centerline channel 708 into the inside of the pin spool 710 through a hole drilled in the wall of the pin spool 713 to a radial cavity around the pin spool 714 that is sealed by O-rings 715, and out a vent channel 716. A retainer plate 717 holds the pin spool in place, and two flat head screws 718 hold the retainer plate in place. Rubber pads 719 are provided to prevent scratching of the fuel cap. When a raised ridge of a standard fuel cap slips into the opening of the grabber head, the pin 712 is depressed, and this causes the channel through the pin spool to be blocked, therefore blocking the vent of air pressure to atmosphere through vent channel 716, and forcing air pressure into the inflatable boots. Thus, air pressure can be supplied when it it desired to grab a fuel cap ridge, but the inflatable boots will not inflate unless a cap ridge is actually inserted into the grabber head.

A fuel inlet nozzle of a vehicle to be refuelled could alternatively be fitted with a cap that allowed insertion of a fuel insert tube through a hinged cover within the cap. A cap would therefore not have to be removed to refuel such a vehicle. The transponder card 106 could be programmed with information indicating whether an original manufactures cap or such alternate design is present.

Referring now to FIGS. 5A, 5B, 6A and 6B along with FIG. 2A, details of the arm for extension of a refuelling tube 203 are shown. A flexible fuel conduit 501 is pushed into and pulled out of a tube sleeve 603 by rubber friction rollers 502. The fiction rollers are driven by an air driven motor 515 driving sprockets 503, 504, 505 and 506 using a link chain 507. The drive motor is shown supported by a drive motor support bracket 513. The air motor 515 drives sprocket 503 directly, and sprockets 505 and 506 each directly drive set of friction rollers through roller axles 514. Sprockets directly driving friction rollers are mounted on pivoting brackets 508 and 509, which pivot about pivot pins 510 and 511, and are urged together at free ends by springs 512. Alternatively, the flexible conduit can be driven into and out of a tube sleeve by pneumatic cylinder attached to the flexible conduit, or a bracket that is attached to the flexible conduit. Use of a pneumatic cylinder could be preferable because of wear that would be caused by the rollers.

The flexible fuel conduit enters a fuelling tube sleeve 603, and is connected to a piston 601 by a low-profile clamp 602. The piston provides a seal between the atmosphere and a volume around the refuelling conduit and inside of the fuelling tube sleeve through which vapors are withdrawn to eliminate emissions of vapors from a fuel tank during a refuelling operation. The piston provides a circular notch for a seal 604, a notch for a circular magnet 605, and a notch for a wear bearing 606. The magnet is incorporated into the piston so the position of the refuelling tube may be monitored by magnetic pick-up 607 at an extended position. The piston 601 also supports a spring 610 that urges forward a push tube 611 through a bushing 612. The piston also connects to a flexible refuelling insert tube 613, which internally provides communication with the flexible fuel conduit 501. A magnet 614 is attached to the refuelling insert tube 613 at a point where the magnetic pick-up 607 detects the magnet when the refuelling insert tube is fully retracted. A seal block 615 is located at the distal end of the refuelling tube sleeve 603. The seal block contains a seal 616 to provide a seal between the inside of the seal block and the outside of the push tube 611. The distal end of the push tube 611 has a shoulder 617 to prevent the push tube from being pulled into the seal block and past the seal 616. A seal boot 619 provides a sealing surface to seal against a fuel inlet of a vehicle. The seal boot extends to the raised shoulder of the push tube, where a clamp 618 secures the boot to the push tube. A support spring 620 provides some support and rigidity to the seal boot, while allowing flexibility for mating the seal surface to the fuel inlet of a vehicle. A push tube insert 621 can be provided to support the support spring for the first portion of its length and a second insert 624 provides support for the boot at the other end.

A vapor path is provided by having the outer diameter of the refuelling tube be less than the inner diameter of the push tube, push tube insert, and seal boot. This vapor path is for removal of vapors from the vehicle fuel tank as fuel is being inserted into the tank through the refuelling insert tube. Vapors can be removed through a vapor outlet 622 to a vapor recovery system (not shown). The vapor path is around the outside of the refuelling insert tube 613, through the inside of the push tube 611, through the bushing 612 and, if necessary, back through the outside of the bushing 612 and the outside of the push tube 611, and to the vapor outlet 622.

The vapor recovery system preferably contains an optical sensor to determine if liquids are within the vapor recovery system, and uses this determination as a back-up shutdown criteria for the refuelling operation. Such a system is disclosed in U.S. Pat. No. 08/461,282, filed Jun. 5, 1995, incorporated herein by reference.

The vapor path for removal of vapors can also be used to sense a slight positive pressure in the fuel tank when this is applied through an air supply port in the fuel line (not shown). Supplying positive pressure of air may be desirable to confirm that the fuel tank does not have a leak, that the fuelling system is in sealing contract with the fuel inlet, and possibly to measure the vapor volume within the fuel tank prior to beginning to refuel, such as by a method disclosed in U.S. Pat. No. 08/461,277, filed Jun. 5, 1995, incorporated herein by reference. A flow of air may also be necessary to refuel a vehicle if the vehicle is equipped with a canister containing activated carbon for proper treatment of vapors being vented through the activated carbon canister.

In a preferred embodiment, a sensor to confirm that the sealing surface of the seal boot 619 is in contact with the fuel inlet is provided by providing a seal boot 619 with at least one slit essentially parallel to the sealing surface between 1/32 and about ½ of an inch from the sealing surface, and providing a supply of air pressure to a lower portion of the slit from a hole drilled to the slit from the non-sealing direction. A signal from a pressure switch on the air supply to this slit will be indicative of whether a sealing contact is being made by the sealing surface. If a sealing contact is being made, the slit will be forced shut, creating a back pressure on the air supply to the slit. A plurality of slits around the circumference of the seal boot are preferred, with a common pressure sensor switch to ensure that a sealing contact is being made at more than one point around the circumference of the seal boot. Alternatively, a tap from the air supply line can go directly to a pneumatic logic system instead of an pressure switch. Such a method to determine if a sealing contact exists is disclosed in U.S. Pat. No. 08/461,278, filed Jun. 5, 1995, incorporated herein by reference.

Figure 8A:
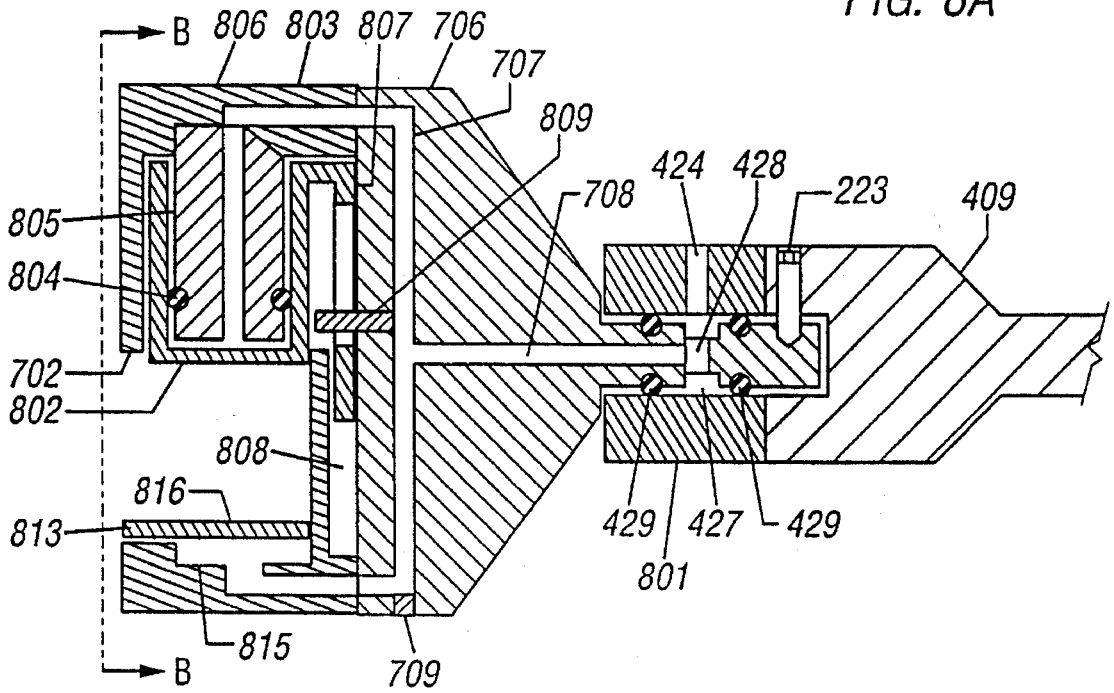
FIGS. 8A and 8B are, respectively, a sectional profile, and a front view of a fuel cap grabbing head according to the present invention.
Figure 8B:
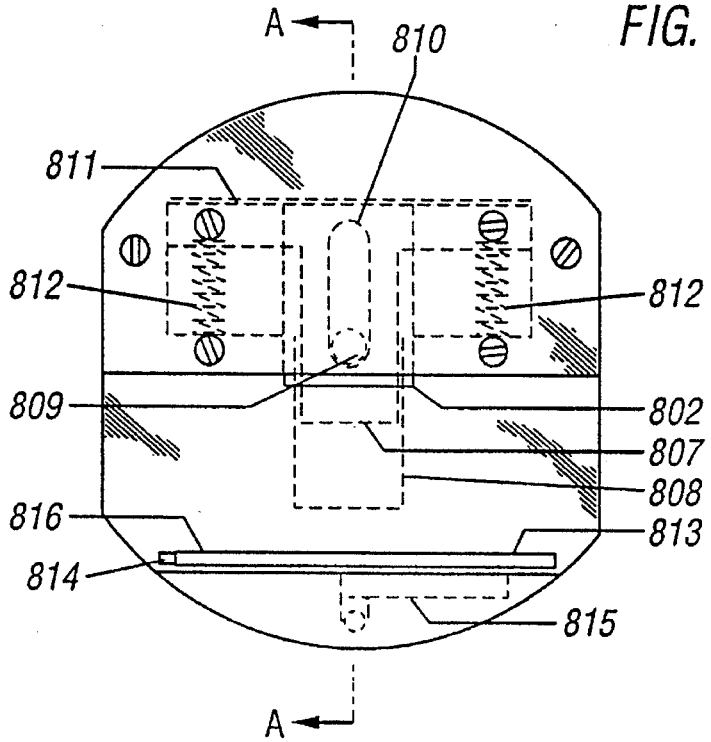

Referring now to FIGS. 8A and 8B, an alternative gas cap grabber is shown. This alternate design is preferred because a much larger opening 702 is provided in the grabbing head 706 compared to the configuration of FIGS. 7A through 7C. Thus, there is a greater tolerance on the positioning of the grabbing head with respect to the cap to be removed. The grabbing head is fixed to a flexible shaft 409 which rotates the grabbing head 706 by a set screw 223. A bearing block 801 secures the grabbing head and defines an air supply channel 424. The channel provides communication to a volume 427 that is contained by two O-rings 429 around the grabbing head 706. A channel 428 provides communication from the volume 427 to a centerline channel 708. The centerline channel provides communication to a perpendicular channel 707. The perpendicular channel 707 is plugged by plug 709 at an end through which it is drilled. A ridge on a gas cap is actually grabbed by a piston 802 that is activated by air pressure through channel 803 that extends from a first end of the perpendicular channel 707. The piston 802 is sealed by an O-ring 804 within a notch in a seal cylinder 805. The seal cylinder 805 is threaded into a piston mount 806. The piston is kept aligned by a guide 807, that slides in a within a void 808 and is further aligned by a pin 809 that slides within a notch 810 in the guide 807. Ears 811 extend from the guide that are attached to springs 812 that urge the piston upward. Thus when air pressure is not applied to the piston, the piston is within the piston mount 806, but when air pressure is applied, the piston is urged out of the piston mount to grasp a ridge of a gas cap. Air pressure is either applied or vented from the perpendicular channel 707 by opening or closing of flap 813.

Flap 813 is connected by a hinge 814 to the grabber head so that insertion and rotation of the grabber head onto a raised ridge of a standard gas cap will result in the flap being held against vent opening 815. The flap may have a rubber pad under the flap, or the opening 815 may include a rubber flap to aid in sealing. The flap may be urged shut be a spring (not shown) in order to retain the flap in an acceptable position without urging the flap with a force that would cause the pressure within the air conduits to close the piston 802. Thus, when the cap grabber of FIGS. 8A and 8B is rotated while being urged against a gas cap having a raised ridge, the raised ridge will slide into the opening and push the flap against the opening, thereby stopping escape of air from the air supply conduits. The pressure of air within the air supply conduits will therefore cause the piston to push out and against the ridge on the gas cap. The piston is capable of extending perpendicular to the axis of rotation of the grabbing head and pinching the raised ridge of the fuel tank cap against a protruding lip 816 of the grabbing head. The gas cap will thereby be "grabbed" until air supply to the cap grabber is discontinued.

Figure 9:
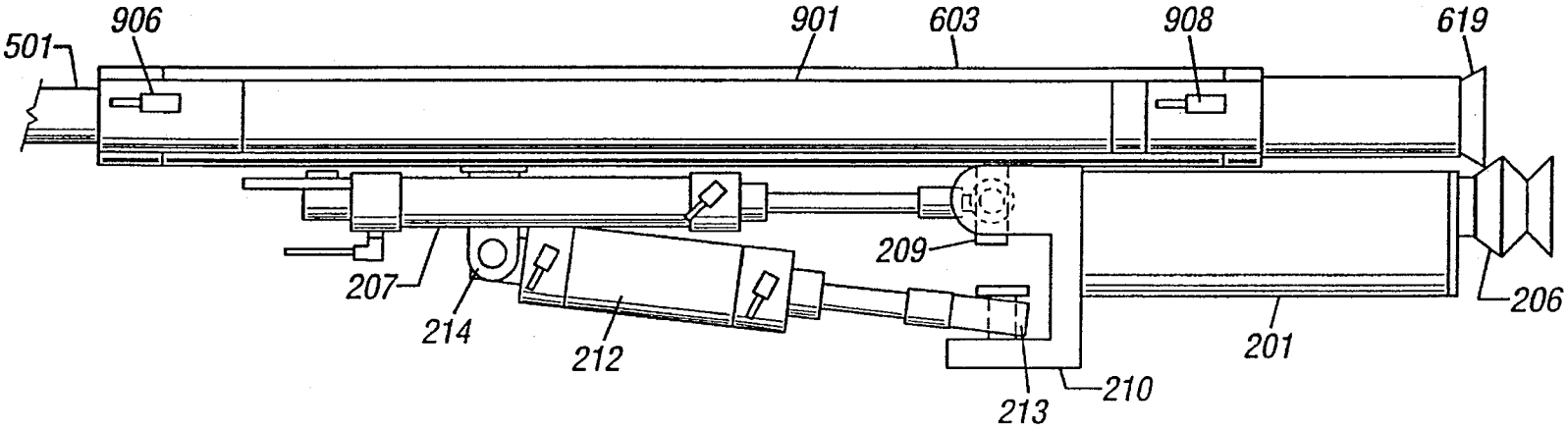
FIGS. 9 and 10 are, respectively, a profile and a top view of an alternative mechanism to insert the fuel conduit into a fuel inlet according to the present invention.
Figure 10:
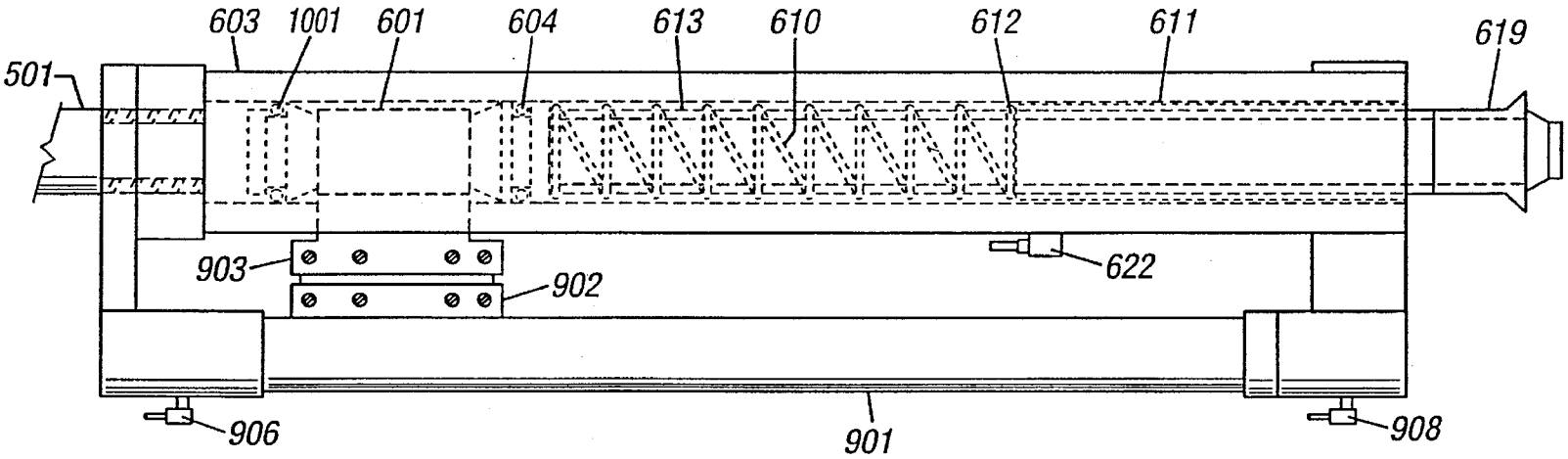

Referring now to FIGS. 9 and 10, two views of an embodiment utilizing rodless cylinders to move the flexible conduit laterally into and out from the fuel inlet are shown. One rodless cylinder is shown as the fuelling tube sleeve 603 and another as a drive cylinder 901. Rodless cylinders are commercially available from, for example, Hoerbiger Automation Technology of Elmhurst, Ill. The rodless cylinders shown in FIGS. 9 and 10 employ a piston that is moved by air pressure on one side or the other with a bracket that extends through a slot along the side of a cylinder housing. The slot is sealed on the inside with a sealing band (not shown) and on the outside of the cylinder with an outer sealing band. The piston is connected to an external piston mounting through the slot, with the bands urged apart between the external piston mounting and the piston to provide a connection between the external mount and the piston. A drive cylinder external piston mounting 902 is connected to an external mount for the hose piston 601. A piston (not shown) of the drive cylinder 901 is driven to a fuelling tube withdrawn position by air pressure from supply air inlet 908, and to a fuelling tube inserted position by air pressure from supply air inlet 906.

The hose piston is within a refuelling piston sleeve 603, which is also a housing for a rodless cylinder. The piston of the rodless cylinder that serves as a fuelling tube sleeve is modified to have a flow-through center and modified to be clamped at each end to a fuel hose. A fuel hose 501 is connected to an ambient side of the piston, and a fuel insert hose 613 is connected to a sealed side of the piston. The sealed side of the piston provides a volume from which a vapor recovery stream can be removed through a vapor outlet 622. The sealed side of the piston is sealed by a seal 604, and a wear bearing 1001 is provided. A spring 610 is connected to the sealed side of the piston, the spring urging outward a push tube 611. A seal boot 619 is attached to the end of a push tube in the matter shown in greater detail in FIGS. 6A and 6B. The configuration of FIGS. 9 and 10 are preferred over the configuration of FIGS. 5A and 5B because the two rodless cylinders are less expensive and more reliable than the rollers of FIGS. 5A and 5B. The rollers could also cause wear on the fuel tube 501 and limit the useful life of that segment of fuel conduit. The rodless cylinders also provide a more compact apparatus that is more visually appealing to a consumer.

The end-effector of the present invention is preferably positioned adjacent to a vehicle fuel inlet by a gantry and manipulator arm such as that disclosed in U.S. patent application Ser. No. 08/461,276, filed Jun. 5, 1995 , incorporated herein by reference, and an automated refuelling process disclosed in U.S. patent application Ser. No. 08/461, 280, filed Jun. 5, 1995, incorporated herein by reference. This preferred manipulator arm vertically extends from an overhead gantry in a telescoping fashion. Because of the vertical telescoping arrangement, a less bulky appearance is achieved, and extension from an overhead gantry reduces exposure to damage by vehicles.

The preceding description of preferred embodiments is exemplary, and reference to the following claims should be made to determine the full scope of the present invention.

We claim:

1. A refuelling system comprising:

a seal cylinder defining the outside surface of an axial vapor recovery volume within the seal cylinder having a first end and a second end;

a flexible fuel conduit to supply fuel to within the seal cylinder through the first end;

a movable piston within the seal cylinder connected to the flexible fuel conduit, the piston effective to isolate at least a portion of the axial vapor recovery volume within the seal cylinder from the atmosphere surrounding the flexible fuel conduit;

an insert tube connected to the seal piston and extending through at least a portion of the vapor recovery volume wherein a portion of the insert tube within the seal cylinder defines the inside surface of the axial vapor recovery volume;

a seal boot attached to the seal cylinder at the second end of the axial vapor recovery volume, the boot seal effective to seal with a fuel tank inlet nozzle; and a means to move the piston laterally through the seal cylinder and thereby moving said flexible fuel conduit through the seal cylinder and extending the insert tube through the second end of the axial vapor recovery volume and into a fuel tank inlet nozzle when the boot seal is mated to the fuel tank inlet nozzle.

2. The refuelling system of claim 1 further comprising an arm interconnected with the seal cylinder for removal of a standard automotive fuel tank cap.

3. The refuelling system of claim 1 further comprising an arm interconnected with the seal cylinder for opening of a hinged lid covering the fuel tank cap.

4. The refuelling system of claim 3 wherein the arm provided for opening of a hinged lid covering the fuel tank cap being arranged to open and hold the hinged lid in an open position while a vehicle is being refuelled.

5. The refuelling system of claim 1 wherein the means to move the seal piston laterally comprises a friction roller that moves the flexible fuel conduit laterally from outside of the seal cylinder.

6. The refuelling system of claim 1 wherein the seal cylinder comprises a refuelling tube sleeve slidably connected to a fixed portion of the seal cylinder.

7. The refuelling system of claim 6 wherein the refuelling tube sleeve is connected to the seal piston by a coiled spring so that movement of the piston laterally toward the second end of the seal cylinder also urges the refuelling tube sleeve out of the fixed portion of the seal cylinder.

8. The refuelling system of claim 1 further comprising a means to remove vapors from the vapor recovery volume for removal of hydrocarbons from the removed vapors.

9. The refuelling system of claim 6 further comprising a seal block attached to the fixed portion of the seal cylinder, the seal block effective to provide a vapor seal between the refuelling tube sleeve and the fixed portion of the seal cylinder.

10. The refuelling system of claim 1 wherein the means to move the seal piston laterally comprises a rodless cylinder having a connection to the seal piston through a sealed slot in the seal cylinder.

11. The refuelling system of claim 2 wherein the arm for removal of a standard automotive fuel tank cap comprises a rotating grabbing head, the rotating grabbing head effective to be secured to a standard automotive fuel tank cap.

12. The refuelling system of claim 11 wherein the grabbing head comprising two inflatable boots that inflate and expand to apply grabbing pressure to sides of a raised ridge on the standard automotive fuel tank cap.

13. The refuelling system of claim 12 further comprising a means to prevent inflation of the inflatable boots when the raised ridge is not in a position to be grabbed by the inflatable boots.

14. The refuelling system of claim 11 wherein the grabbing head comprises a piston capable of extending perpendicular to the axis of rotation of the grabbing head and pinching a raised ridge of the fuel tank cap against a protruding lip of the grabbing head.

* * * * *